US008839544B2

(12) United States Patent
Troy et al.

(10) Patent No.: US 8,839,544 B2
(45) Date of Patent: Sep. 23, 2014

(54) FOREGRIP FOR FIREARM

(71) Applicants: Stephen P. Troy, Lee, MA (US); David A. Hewes, Chesterfield, MA (US)

(72) Inventors: Stephen P. Troy, Lee, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 0 days.

(21) Appl. No.: 14/065,221

(22) Filed: Oct. 28, 2013

(65) Prior Publication Data

US 2014/0115939 A1 May 1, 2014

Related U.S. Application Data

(60) Provisional application No. 61/719,586, filed on Oct. 29, 2012.

(51) Int. Cl.
*F41C 23/16* (2006.01)

(52) U.S. Cl.
CPC ..... *F41C 23/16* (2013.01)
USPC ..... 42/72

(58) Field of Classification Search
USPC ..... 42/71.01, 72, 94; 89/1.42
See application file for complete search history.

(56) References Cited

U.S. PATENT DOCUMENTS 3,225,656 A * 12/1965 Flaherty et al. ..... 89/37.04
7,464,495 B2 * 12/2008 Cahill ..... 42/72
8,245,428 B2 * 8/2012 Griffin ..... 42/72

* cited by examiner

*Primary Examiner* — Reginald Tillman, Jr.
(74) *Attorney, Agent, or Firm* — Parsons & Goltry; Robert A. Parsons; Michael W. Goltry

(57) ABSTRACT

A foregrip for use with a firearm having a handguard extending along the barrel and a mounting rail, with transverse spaced apart slots, extending longitudinally along a lower surface of the handguard parallel with the barrel and including slots spaced there along. The foregrip including a member formed to engage the mounting rail and slide longitudinally there along. The member includes a transverse slot formed through an upwardly directed surface thereof. A gripping member has an upper end formed to engage the mounting rail engaging member. A bar clamp carried by the gripping member is positioned to slide into the slot in the mounting rail engaging member and extend into engagement with a slot in the mounting rail, whereby the foregrip is positioned at a selected position longitudinally along the mounting rail.

16 Claims, 7 Drawing Sheets

FOREGRIP FOR FIREARM

CROSS-REFERENCE TO RELATED APPLICATION

This application claims the benefit of U.S. Provisional Patent Application No. 61/719,586, filed 29 Oct. 2012

FIELD OF THE INVENTION

This invention relates to grips for use on firearms. More particularly, the present invention relates to the use of front grips on firearms.

BACKGROUND OF THE INVENTION

Firearms of the automatic and/or semiautomatic type generally include some form of front grip, for use during shooting exercises. In the prior art the front grips are either simply downwardly extending members generally with a rectangular cross-section or are constructed to perform other functions, e.g. tripods, accessory mounts, etc. In many instances the prior art front grips cannot be locked solidly in the desired position and have a tendency to slip along the mounting rail, which may affect the stability during shooting. Also, in many instances the prior art front grips are difficult to grip comfortably and can affect the stability with which the firearm is held.

It would be highly advantageous, therefore, to remedy the foregoing and other deficiencies inherent in the prior art.

Accordingly, it is an object of the present invention to provide a new and improved foregrip for mounting on firearms.

It is another object of the present invention to provide new and improved foregrip that can conveniently be mounted on a firearm in any downwardly extending orientation and locked solidly in a selected position.

It is another object of the present invention to provide new and improved foregrip that is comfortable to grip and thereby improves shooting stability.

SUMMARY OF THE INVENTION

Briefly, to achieve the desired objects of the instant invention in accordance with a preferred embodiment thereof, a foregrip is disclosed. The foregrip is designed for use with a firearm having a handguard extending along the barrel and a mounting rail, with transverse spaced apart slots, extending longitudinally along a lower surface of the handguard parallel with the barrel and the mounting rail including slots spaced longitudinally there along and extending transverse to the barrel. The foregrip includes a mounting rail engaging member formed to engage the mounting rail and slide longitudinally there along. The mounting rail engaging member includes an upwardly directed surface designed to be adjacent and parallel with a lower surface of the mounting rail with the mounting rail engaging member engaged with the mounting rail. The mounting rail engaging member further includes a transverse slot formed through the upwardly directed surface of the mounting rail engaging member. A gripping member has an upper end formed to removably and securely engage a lower portion of the mounting rail engaging member with the gripping member in a downwardly extending orientation. A bar clamp is carried by the gripping member and positioned to slide into the slot in the mounting rail engaging member so as to extend above the upwardly directed surface with the gripping member engaged with mounting rail engaging member. Whereby the bar clamp engages a transverse spaced apart slot in the mounting rail with the mounting rail engaging member positioned at a selected position longitudinally along the mounting rail and the gripping member securely engaged with the mounting rail engaging member.

The desired objects of the instant invention are further achieved in accordance with an embodiment of a foregrip on a firearm. The firearm has a handguard extending along the barrel and a mounting rail with a dovetail cross-section and with transverse spaced apart slots, extending longitudinally along a lower surface of the handguard parallel with the barrel. The mounting rail includes slots spaced longitudinally there along and extending transverse to the barrel. A mounting rail engaging member includes a longitudinally extending dovetail track engaged with the mounting rail of the handguard and slideable longitudinally there along. The mounting rail engaging member includes an upwardly directed surface adjacent to and parallel with a lower surface of the mounting rail. The mounting rail engaging member further includes a transverse slot formed through the upwardly directed surface of the mounting rail engaging member. A gripping member includes a tubular body designed to be gripped with a hand of the firearm operator and having an upper end removably and securely engaged with a lower portion of the mounting rail engaging member with the gripping member in a downwardly extending orientation. A bar clamp is carried by the gripping member and positioned in the slot in the mounting rail engaging member so as to extend above the upwardly directed surface. The bar clamp is engaged in a selected transverse spaced apart slot in the mounting rail and the mounting rail engaging member is positioned at a selected position longitudinally along the mounting rail. A lower sealing member is engaged with the lower end of the tubular body.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
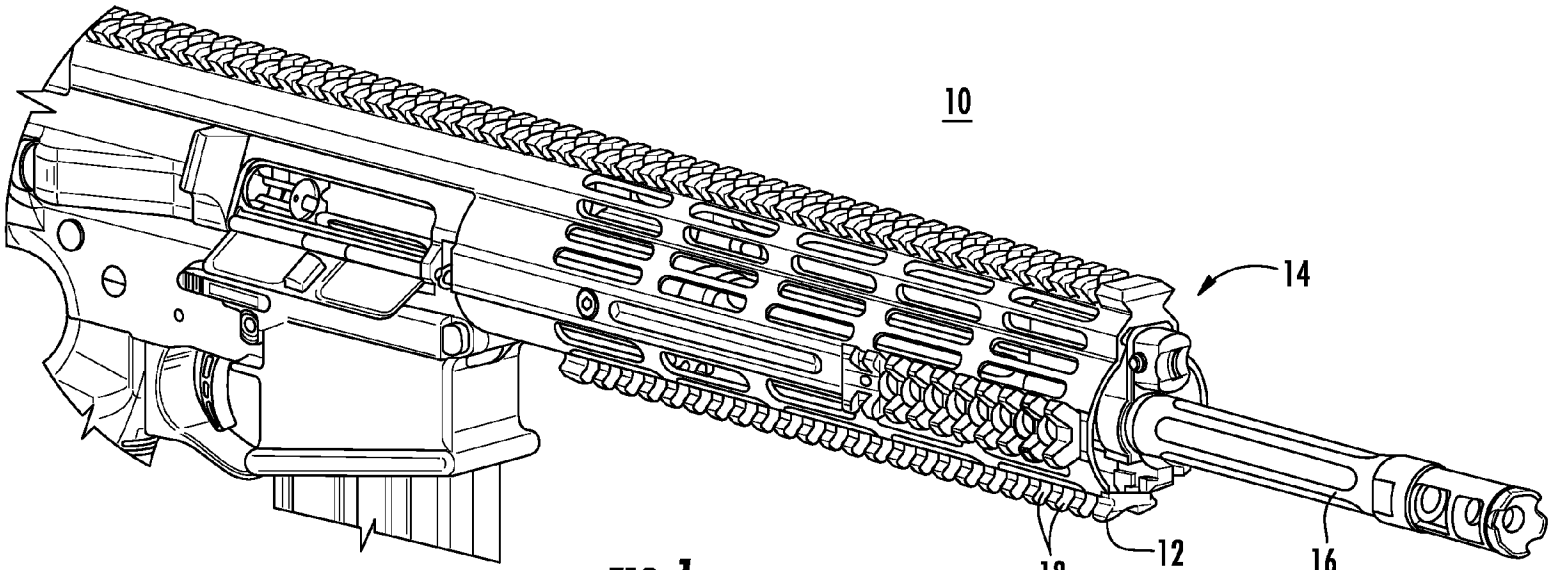
FIG. 1 is a side perspective view of a typical firearm illustrating the lower mounting rail.
Figure 2:
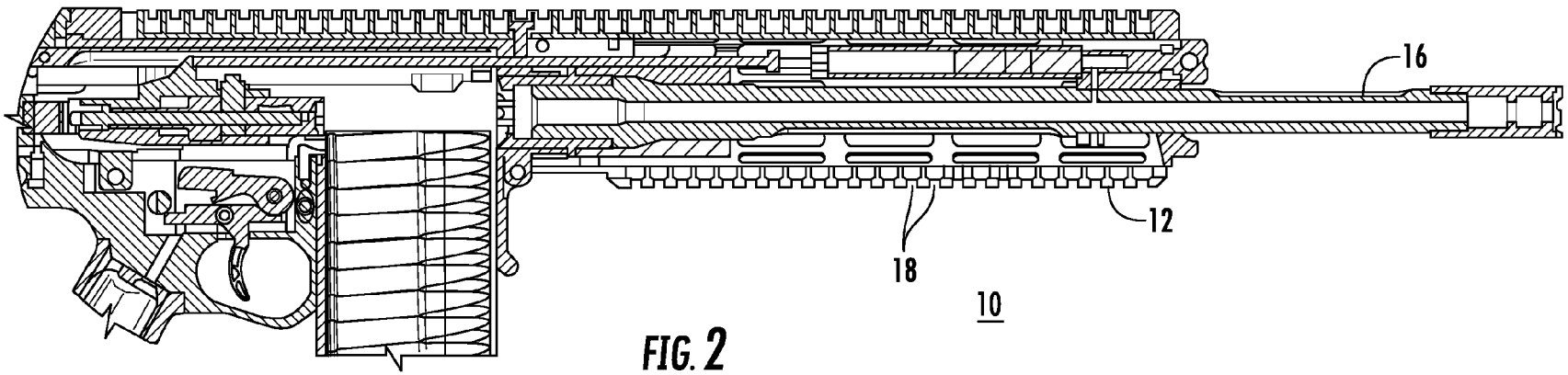
FIG. 2 is a sectional side view of the firearm of FIG. 1 illustrating the lower mounting rail in more detail.

Turning to FIGS. 1 and 2, a typical firearm 10 is illustrated showing a lower mounting rail 12 extending along the lower surface of a handguard 14 parallel with the barrel 16 of firearm 10. As understood by those skilled in the art, mounting rail 12 has a generally dovetailed cross-sectional shape designed specifically to mount accessories thereon. Further, mounting rail 12 includes lateral grooves 18 extending laterally through mounting rail 12 and spaced apart substantially equal distances along the entire length of mounting rail 12.

Figure 3:
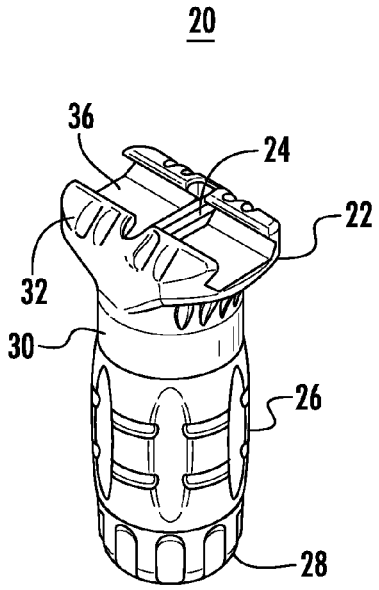
FIG. 3 is a perspective view of a foregrip, in accordance with the present invention.
Figure 4:
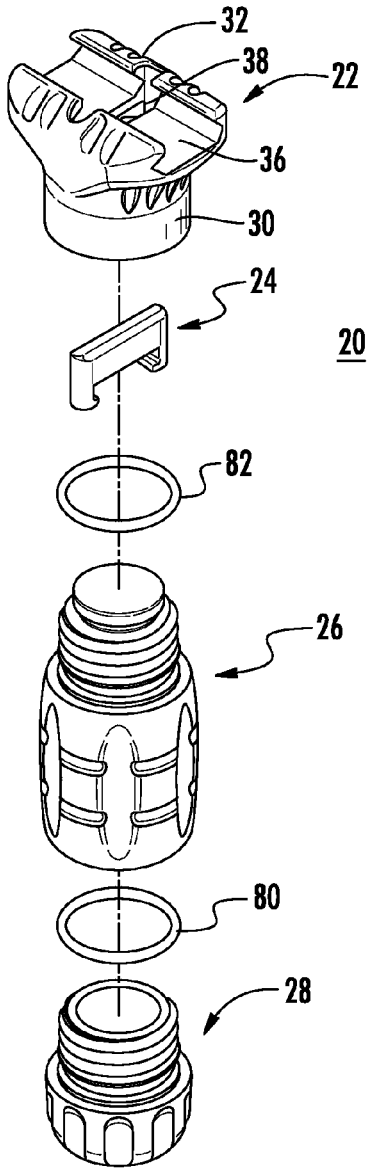
FIG. 4 is an exploded view of the foregrip of FIG. 3.
Figure 5:
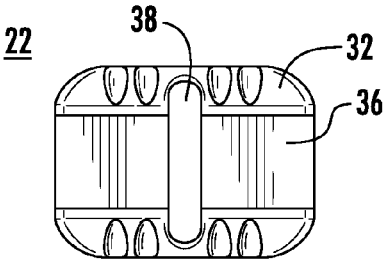
FIG. 5 is a top view of a rail-engaging member of the foregrip of FIG. 3.
Figure 6:
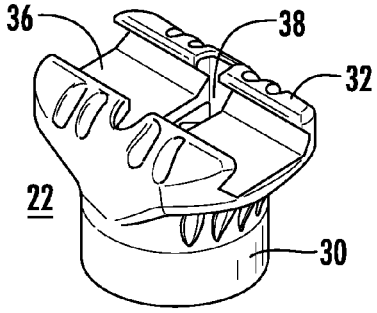
FIG. 6 is a top perspective view of the rail-engaging member of the foregrip of FIG. 3.
Figure 7:
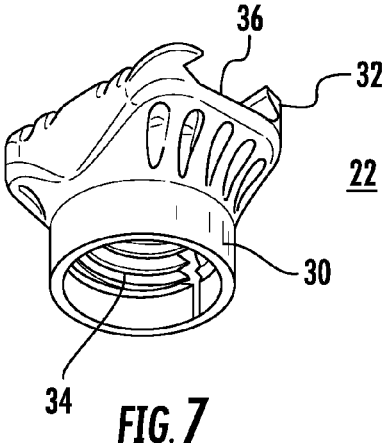
FIG. 7 is a bottom perspective view of the rail-engaging member of the foregrip of FIG. 3.
Figure 8:
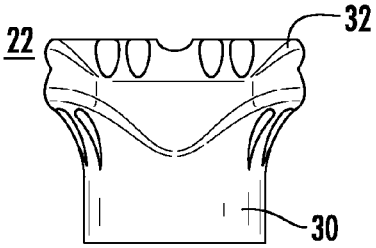
FIG. 8 is a side view of the rail-engaging member of the foregrip of FIG. 3.
Figure 9:
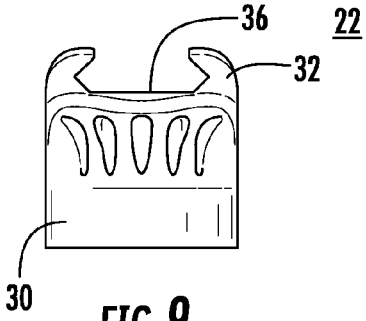
FIG. 9 is a front view of the rail-engaging member of the foregrip of FIG. 3.
Figure 10:
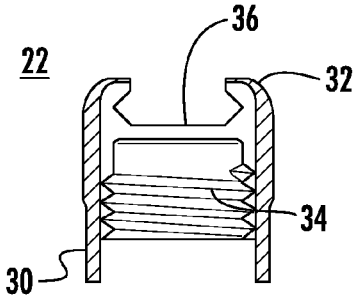
FIG. 10 is a sectional front view of the rail-engaging member of the foregrip of FIG. 3.

Turning now to FIGS. 3 and 4, a foregrip 20, in accordance with the present invention, is illustrated. Foregrip 20 includes a rail-engaging member 22, a bar clamp 24, a gripping member 26, and a lower sealing member 28. As illustrated best in FIG. 3, the various components or members are threaded together to form an easily and comfortably grasped forward or front grip that can be fixedly positioned on mounting rail 12 (as described below) in substantially any selected longitudinal position.

Referring additionally to FIGS. 5-10, rail-engaging member 22 of foregrip 20 is illustrated in more detail. As can be seen in the figures, member 22 has a tubular lower end 30 that flairs outwardly toward the front and back (front end and back end of firearm 10) to form an elongated upper end 32. Tubular lower end 30 has internal threads 34 formed therein to receive an upper threaded end of gripping member 26 in threaded engagement therewith as described in more detail below. Elongated upper end 32 has a track 36 formed therein that extends from the front to the back and has a generally dovetailed cross-section designed to slideably engage mounting rail 12 therein. The combination of the dovetailed mounting rail 12 and the matching dovetailed track 36 ensures that foregrip 20 can be slid longitudinally along mounting rail 12 while preventing any lateral movement or disengagement.

A slot 38 is formed internally in upper end 32 of rail-engaging member 22. Slot 38 extends transversely from adjacent one edge of upper end 32 to the other, parallel with the transverse diameter of tubular lower end 30. Further, slot 38 is designed to receive bar clamp 24 therein for easy, unbinding vertical (in the figures) movement between a position in which an upper surface of bar clamp 24 (see FIG. 11) is positioned below the bottom surface of track 36 and a position in which a substantial portion of bar clamp 24 extends above the bottom surface of track 36.

Figure 12:
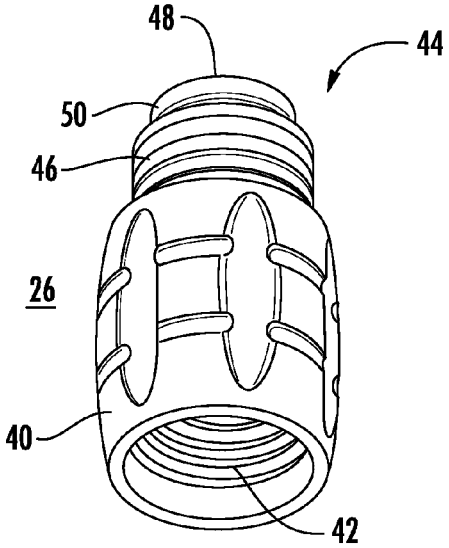
FIG. 12 is a bottom perspective view of a gripping member of the foregrip of FIG. 3.
Figure 13:
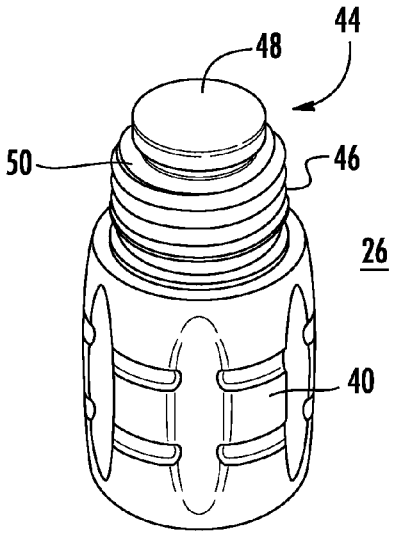
FIG. 13 is a top perspective view of the gripping member of the foregrip of FIG. 3.
Figure 14:
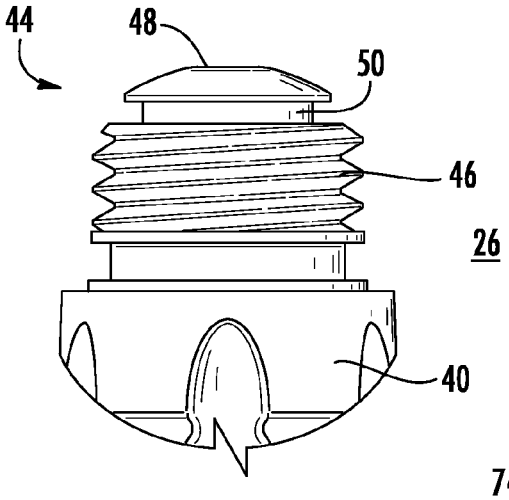
FIG. 14 is an enlarged side view of the gripping member of the foregrip of FIG. 3, portions thereof removed.

Referring additionally to FIGS. 12-14, gripping member 26 is illustrated in more detail. As can be seen in the figures, gripping member 26 includes a tubular body 40 with an outer surface designed to be firmly, comfortably, and stably gripped by a firearm operator. Tubular body 40 further includes internal threads designed to receive lower sealing member 28 threadedly engaged therein, as will be described in more detail below. Gripping member 26 terminates in an upper end 44 which is preferably formed integral with and as an extension of tubular body 40. Upper end 44 includes outer threads 46 designed to be received in tubular lower end 30 of rail-engaging member 22 and further designed to be threadedly engaged in internal threads 34 of rail-engaging member 22.

Upper end 44 of gripping member 26 further includes a terminating cap 48 at the extreme upper end thereof. A circumferentially extending and radially inwardly directed groove 50 is formed between the upper end of threads 46 and the lower surface of cap 48. As can be seen by comparing FIGS. 13 and 14, cap 48 can be formed in a variety of convenient configurations, such as a simply flat upper surface (FIG. 13), a convex or dome-shaped surface (FIG. 14), or any desirable shape in between.

Figure 11A:
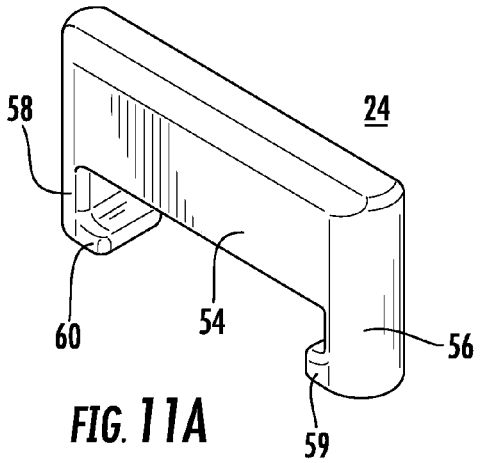
FIGS. 11 (*a-c*) are an enlarged perspective, front, and end views of a bar clamp of the foregrip of FIG. 3.
Figure 11B:
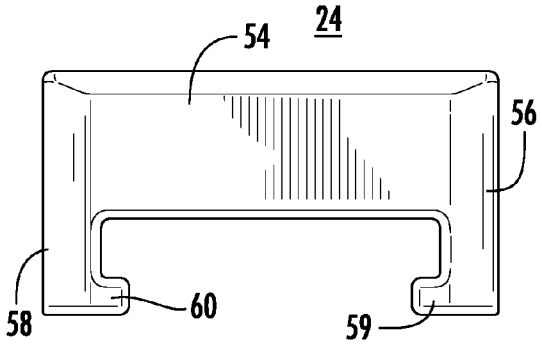
Figure 11C:
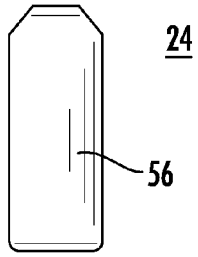

Referring additionally to FIGS. 11*a*-11*c*, bar clamp 24 is illustrated in detail. Bar clamp 24 includes a bar-shaped body portion 54 with downwardly directed legs 56 and 58 at opposite sides thereof. Each leg 56 and 58 includes an inwardly directed tang 59 and 60, respectively, adjacent the lower end thereof. Tangs 59 and 60 are designed to be slideably engaged in groove 50 adjacent the upper end of gripping member 26. Further, bar-shaped body portion 54 of bar clamp 24 is designed to be slideably engaged in slot 38 of rail-engaging member 22 for vertical (upward and downward sliding movement) movement as external threads 46 of gripping member 26 are threadedly engaged in internal threads 34 of rail-engaging member 22. Also, the upper edge of bar-shaped body portion 54 is formed to be engaged in any one of lateral grooves 18 extending laterally through mounting rail 12 of firearm 10.

Figure 15:
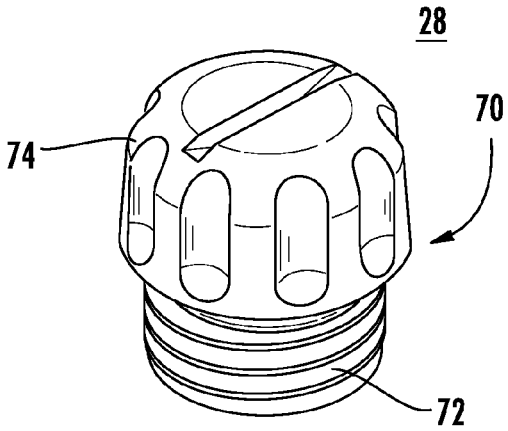
FIG. 15 is a top perspective view of a lower sealing member of the foregrip of FIG. 3.
Figure 16:
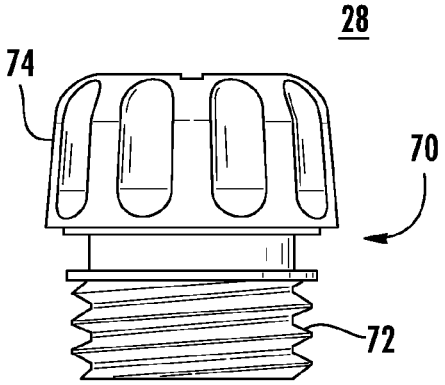
FIG. 16 is a side view of the lower sealing member of the foregrip of FIG. 3.
Figure 17:
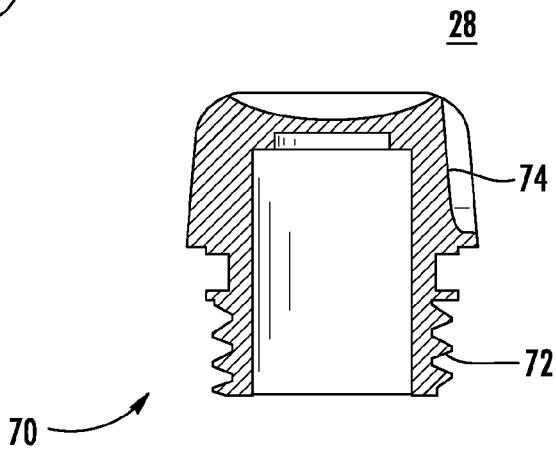
FIG. 17 is a sectional side view of the lower sealing member of the foregrip of FIG. 3.
Figure 18:
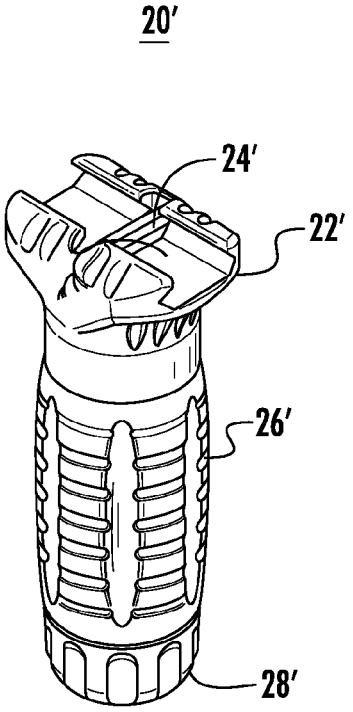
FIGS. 18-22 are various views of another example of a foregrip, in accordance with the present invention.
Figure 19:
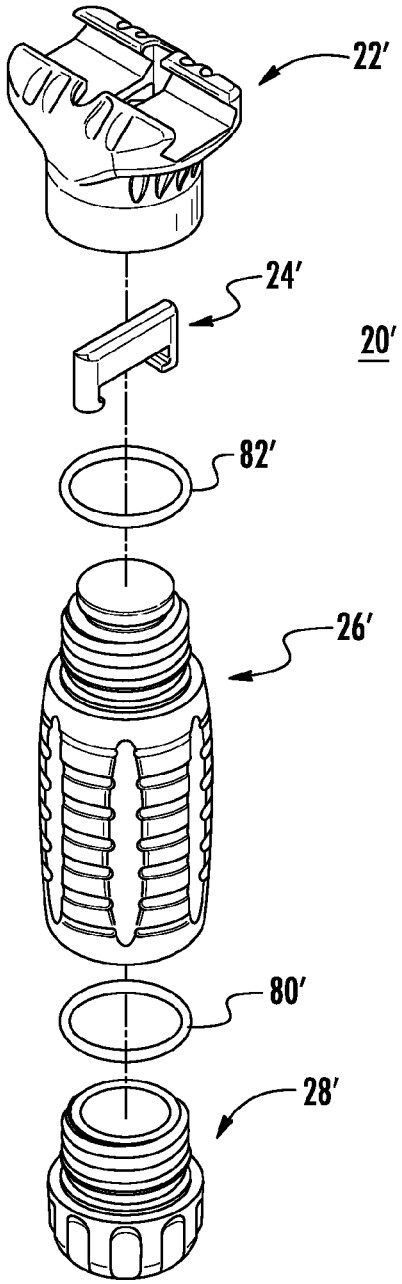
Figure 20:
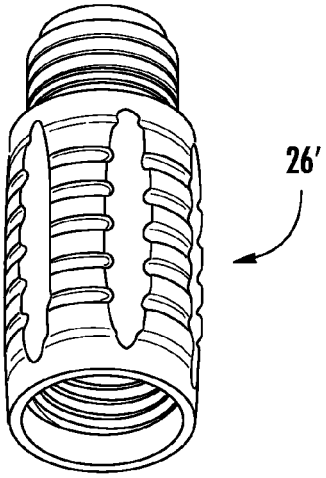
Figure 21:
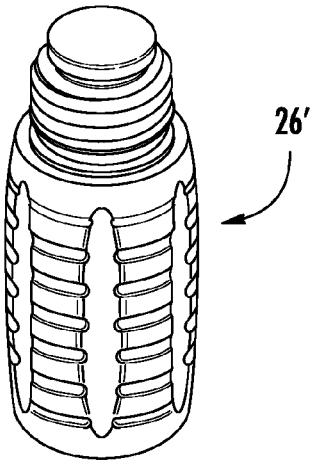
Figure 22:
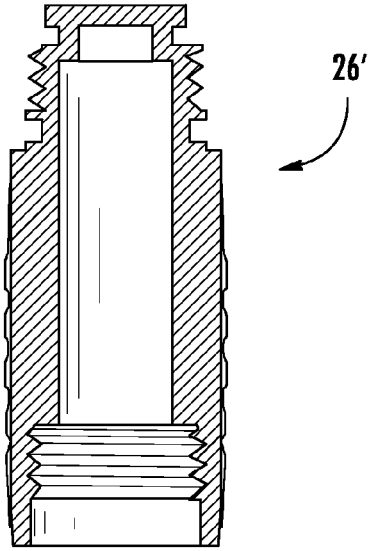

Referring additionally to FIGS. 15-17, lower sealing member 28 is illustrated in more detail. Lower sealing member 28 includes a tubular body 70 with external threads 72 extending along a substantial portion thereof. An enlarged generally knob-shaped portion 74 completes and terminates tubular body 70. Knob-shaped portion 74 is designed to provide easy gripping of lower sealing member 28 for threadedly engaging lower sealing member 28 in the lower end of gripping member 26.

In the assembly and operation or positioning of foregrip 20 at a selected position along mounting rail 12 on firearm 10, lower sealing member 28 is threadedly engaged in the lower end of gripping member 26. An O-ring 80 (see FIG. 40) is positioned between lower sealing member 28 and the lower end of gripping member 26 to provide a moisture tight seal. The upper end of gripping member 26 is threaded partially into the lower end of rail-engaging member 22 so that bar clamp 24 does not extend above the bottom surface of track 36. An O-ring 82 (see FIG. 40) is positioned between the upper end of gripping member 26 and the lower end of rail-engaging member 22 to provide a moisture tight seal. With rail-engaging member 22 and gripping member 26 partially engaged together, track 36 is slideably engaged with mounting rail 12 and foregrip 20 is slid along mounting rail 12 to a desired position. Gripping member 26 is then threaded firmly into the lower end of rail-engaging member 22 so that bar-shaped body portion 54 of bar clamp 24 is forced firmly into one of lateral grooves 18 of mounting rail 12. Foregrip 20 is thus firmly and stably mounted on firearm 10 at the selected position and will not inadvertently slip or move in any direction.

Figure 23:
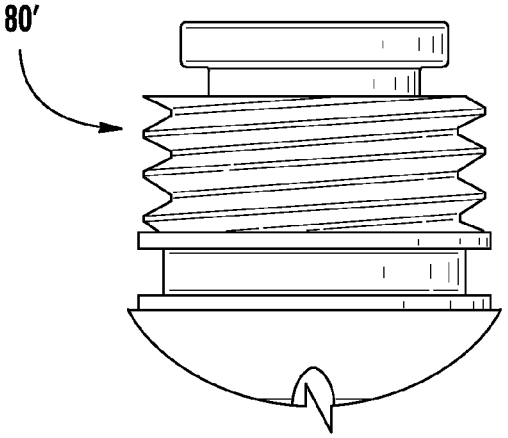
FIG. 23 illustrates an example of a different lower sealing member, in accordance with the present invention.

Referring to FIGS. 18-22, an example of a slightly different foregrip 20' is illustrated with components similar to the example illustrated in FIGS. 3-17 designated with similar numbers having a prime (') added to indicate the different example. It can be seen from a comparison of the two examples that at least the gripping member can be formed with different shapes and sizes to accommodate different additional purposes or user sizes. For example, the inner sealed chamber of either foregrip 20 or 20' might be designed to carry various additional objects. Also, providing the inner chamber reduces the weight of either foregrip 20 or 20' and may be simply sealed if not used for storage purposes. FIG. 23 illustrates a different lower sealing member, demonstrating that a variety of different lower sealing members can be incorporated if desired.

Thus, a new and improved foregrip is illustrated and described. The new and improved foregrip is designed to provide a user with a more stable and convenient mount and is specifically designed to be easily and conveniently installed on any firearm by means of a standard dovetail rail. The foregrip positively engages a standard dovetail rail preventing any movement once engaged and can be easily and quickly attached or moved to any position along the rail.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. A foregrip for use with a firearm having a handguard extending along the barrel and a mounting rail, with transverse spaced apart slots, extending longitudinally along a lower surface of the handguard parallel with the barrel, the mounting rail including slots spaced longitudinally there along and extending transverse to the barrel, the foregrip comprising:

a mounting rail engaging member formed to engage the mounting rail and slide longitudinally there along, the mounting rail engaging member including an upwardly directed surface designed to be adjacent and parallel with a lower surface of the mounting rail when the mounting rail engaging member is engaged with the mounting rail, the mounting rail engaging member including a transverse slot formed through the upwardly directed surface of the mounting rail engaging member, and a threaded tubular lower end;

a gripping member having an upper end formed to removably and securely engage a lower portion of the mounting rail engaging member with the gripping member in a downwardly extending orientation, the gripping member includes a tubular body designed to be gripped with a hand of the firearm operator and has a threaded upper end, the threaded upper end being formed to threadedly engage the threaded lower end of the mounting rail engaging member removably and securely; and a bar clamp carried by the gripping member, the bar clamp including a bar-shaped body portion with two downwardly directed legs each terminating with inwardly directed tangs, the bar-shaped body portion is positioned at the upper end of the gripping member with the tangs engaging the upper end, whereby the bar shaped body portion is positioned in the transverse slot formed through the upwardly directed surface of the mounting rail with the gripping member threadedly engaged with the mounting rail engaging member and positioned to be extendable above the upwardly directed surface as the gripping member is threadably engaged with mounting rail engaging member, whereby the bar clamp is engagable with a transverse spaced apart slot in the mounting rail with the mounting rail engaging member positioned at a selected position longitudinally along the mounting rail and the gripping member securely engaged with the mounting rail engaging member.

2. The foregrip as claimed in claim 1 wherein the mounting rail of the firearm has a dovetail cross-section and the upper end of the mounting rail engaging member includes a longitudinally extending dovetail track formed to longitudinally slideably engage the mounting rail of the handguard, a surface of the longitudinally extending dovetail track defining the upwardly directed surface.

3. The foregrip as claimed in claim 1 wherein the bar shaped body portion of the bar clamp is movable in the transverse slot, as the gripping member is threadedly engaged with the mounting rail engaging member, between a lower position for disengagement from the spaced slots in the mounting rail and an upper position for engagement in a selected one of the spaced slots in the mounting rail.

4. The foregrip as claimed in claim 1 wherein the tubular body of the gripping member includes a lower threaded end and wherein the foregrip further includes a lower sealing member with threads formed to threadedly engage the lower threaded end of the tubular body.

5. The foregrip as claimed in claim 4 further including an O-ring positioned between the mounting rail engaging member and the gripping member and an O-ring positioned between the gripping member and the lower sealing member, the O-rings sealing an inner chamber in the gripping member with a moisture tight seal.

6. The foregrip as claimed in claim 1 wherein the tubular body of the gripping member extends downwardly a length approximately the width of a human hand.

7. A foregrip for use with a firearm having a handguard extending along the barrel and a mounting rail with a dovetail cross-section and with transverse spaced apart slots, extending longitudinally along a lower surface of the handguard parallel with the barrel, the mounting rail including slots spaced longitudinally there along and extending transverse to the barrel, the foregrip comprising:

a mounting rail engaging member including a longitudinally extending dovetail track formed to engage the mounting rail of the handguard and slide longitudinally there along, the mounting rail engaging member including an upwardly directed surface designed to be adjacent and parallel with a lower surface of the mounting rail when the mounting rail engaging member is engaged with the mounting rail, the mounting rail engaging member including a transverse slot formed through the upwardly directed surface of the mounting rail engaging member, and a threaded tubular lower end;

a gripping member including a tubular body designed to be gripped with a hand of the firearm operator and having a threaded upper end formed to threadedly engage the threaded lower end of the mounting rail engaging member with the gripping member in a downwardly extending orientation;

a bar clamp carried by the gripping member, the bar clamp including a bar-shaped body portion with two downwardly directed legs each terminating with inwardly directed tangs, the bar-shaped body portion is positioned at the upper end of the gripping member with the tangs engaging the upper end, whereby the bar shaped body portion is positioned in the transverse slot formed through the upwardly directed surface of the mounting rail with the gripping member threadedly engaged with the mounting rail engaging member and positioned to be extendable above the upwardly directed surface as the gripping member is threadably engaged with mounting rail engaging member, whereby the bar clamp is engagable with a transverse spaced apart slot in the mounting rail with the mounting rail engaging member positioned at a selected position longitudinally along the mounting rail and the gripping member securely engaged with the mounting rail engaging member; and a lower sealing member formed to engage the lower end of the tubular body.

8. The foregrip as claimed in claim 7 wherein the bar shaped body portion of the bar clamp is movable in the transverse slot, as the gripping member is threadedly engaged with the mounting rail engaging member, between a lower position for disengagement from the spaced slots in the mounting rail and an upper position for engagement in a selected one of the spaced slots in the mounting rail.

9. The foregrip as claimed in claim 7 wherein the tubular body of the gripping member includes a lower threaded end and wherein the lower sealing member includes threads formed to threadedly engage the lower threaded end of the tubular body.

10. The foregrip as claimed in claim 7 further including an O-ring positioned between the mounting rail engaging member and the gripping member and an O-ring positioned between the gripping member and the lower sealing member, the O-rings sealing an inner chamber in the gripping member with a moisture tight seal.

11. The foregrip as claimed in claim 7 wherein the tubular body of the gripping member extends downwardly a length approximately the width of a human hand.

12. A foregrip on a firearm comprising:

a firearm having a handguard extending along the barrel and a mounting rail with a dovetail cross-section and with transverse spaced apart slots, extending longitudinally along a lower surface of the handguard parallel with the barrel, the mounting rail including slots spaced longitudinally there along and extending transverse to the barrel;

a mounting rail engaging member including a longitudinally extending dovetail track engaged with the mounting rail of the handguard and slideable longitudinally there along, the mounting rail engaging member including an upwardly directed surface adjacent to and parallel with a lower surface of the mounting rail, the mounting rail engaging member including a transverse slot formed through the upwardly directed surface of the mounting rail engaging member, and a threaded tubular lower end;

a gripping member including a tubular body designed to be gripped with a hand of the firearm operator and having a threaded upper end threadedly engaging the threaded lower end of the mounting rail engaging member with the gripping member in a downwardly extending orientation;

a bar clamp carried by the gripping member and positioned in the slot in the mounting rail engaging member so as to extend above the upwardly directed surface, the bar clamp being engaged in a selected transverse spaced apart slot in the mounting rail and the mounting rail engaging member being positioned at a selected position longitudinally along the mounting rail; and a bar clamp carried by the gripping member and positioned in the slot in the mounting rail engaging member so as to extend above the upwardly directed surface, the bar clamp being engaged in a selected transverse spaced apart slot in the mounting rail and the mounting rail engaging member being positioned at a selected position longitudinally along the mounting rail, the bar clamp including a bar-shaped body portion with two downwardly directed legs each terminating with inwardly directed tangs, the bar-shaped body portion positioned at the upper end of the gripping member with the tangs engaging the upper end, the bar shaped body portion extending through the transverse slot formed through the upwardly directed surface of the mounting rail and engaged with the selected transverse spaced apart slot in the mounting rail; and a lower sealing member engaged with the lower end of the tubular body.

13. The foregrip on a firearm as claimed in claim 12 wherein the bar shaped body portion of the bar clamp is movable in the transverse slot, as the gripping member is threadedly engaged with the mounting rail engaging member, between a lower position disengaged from the spaced slots in the mounting rail and an upper position engaged in a selected one of the spaced slots in the mounting rail.

14. The foregrip on a firearm as claimed in claim 12 wherein the tubular body of the gripping member includes a lower threaded end and wherein the lower sealing member includes threads threadedly engaged with the lower threaded end of the tubular body.

15. The foregrip on a firearm as claimed in claim 12 further including an O-ring positioned between the mounting rail engaging member and the gripping member and an O-ring positioned between the gripping member and the lower sealing member, the O-rings sealing an inner chamber in the gripping member with a moisture tight seal.

16. The foregrip on a firearm as claimed in claim 12 wherein the tubular body of the gripping member extends downwardly a length approximately the width of a human hand.

* * * * *